US009745838B2

(12) United States Patent
Gorrara et al.

(10) Patent No.: US 9,745,838 B2
(45) Date of Patent: Aug. 29, 2017

(54) TUBULAR ASSEMBLY AND METHOD OF DEPLOYING A DOWNHOLE DEVICE USING A TUBULAR ASSEMBLY

(75) Inventors: Andrew Gorrara, Stonehaven (GB); Peter Wood, Aberdeen (GB)

(73) Assignee: SCHLUMBERGER TECHNOLOGY CORPOATION, Sugar Land, TX (US)

( * ) Notice: Subject to any disclaimer, the term of this patent is extended or adjusted under 35 U.S.C. 154(b) by 88 days.

(21) Appl. No.: 14/119,205

(22) PCT Filed: Jun. 8, 2012

(86) PCT No.: PCT/GB2012/051298
§ 371 (c)(1),
(2), (4) Date: Jan. 15, 2014

(87) PCT Pub. No.: WO2012/168728
PCT Pub. Date: Dec. 13, 2012

(65) Prior Publication Data

US 2014/0124199 A1 May 8, 2014

(30) Foreign Application Priority Data

Jun. 10, 2011 (GB) ..... 1109690.6

(51) Int. Cl.
*E21B 43/14* (2006.01)
*E21B 23/02* (2006.01)
(Continued)

(52) U.S. Cl.
CPC ..... *E21B 43/14* (2013.01); *E21B 17/00* (2013.01); *E21B 23/00* (2013.01); *E21B 23/02* (2013.01);
(Continued)

(58) Field of Classification Search
CPC .... E21B 43/103; E21B 43/105; E21B 43/108; E21B 43/10; E21B 43/14; E21B 43/11;
(Continued)

(56) References Cited

U.S. PATENT DOCUMENTS 2,804,148 A * 8/1957 Schremp ..... E21B 10/003 166/113
2,927,638 A * 3/1960 Hall, Sr. ..... E21B 33/1295 166/122
(Continued)

FOREIGN PATENT DOCUMENTS

GB 2382832 A 6/2003
GB 2383361 A 6/2003
(Continued)

*Primary Examiner* — Yong-Suk (Philip) Ro

(57) ABSTRACT

A tubular assembly is disclosed for use in a wellbore (5) of an oil, gas or water well, typically for landing a downhole device in the wellbore. The assembly has a sleeve (1) adapted to receive the body of the downhole device. The sleeve is deployed into a conduit in the wellbore and expanded, so that the outer circumferential surface of the sleeve is radially expanded against the inner surface of the conduit. The sleeve has a bore with an inner circumferential surface comprising an inwardly facing formation adapted to engage with an outwardly facing formation on the body of the downhole device when the body of the downhole device is disposed in the bore of the sleeve. The sleeve is typically deployed in the wellbore at the desired location and is radially expanded by an expander device (2) that is deployed within the bore of the sleeve. The expanded sleeve plastically deforms and retains its expanded configuration after the radial expansion force is removed from the sleeve. The sleeve provides a modular anchoring or landing point in the wellbore that can be retrospectively set in the conduit at different locations, and various downhole devices can then be deployed into the sleeves at predictable depths and a
(Continued)

reliable connection can be made with the sleeve. The assembly can typically pass through a smaller diameter before being morphed to seal and anchor in a larger diameter.

16 Claims, 12 Drawing Sheets

(51) Int. Cl.

| | |
|---|---|
| ***E21B 43/10*** | (2006.01) |
| ***E21B 29/00*** | (2006.01) |
| ***E21B 33/124*** | (2006.01) |
| ***E21B 43/25*** | (2006.01) |
| ***E21B 47/04*** | (2012.01) |
| ***E21B 17/00*** | (2006.01) |
| ***E21B 23/00*** | (2006.01) |
| ***E21B 29/08*** | (2006.01) |
| ***E21B 43/11*** | (2006.01) |

(52) U.S. Cl.
CPC ..... *E21B 29/002* (2013.01); *E21B 29/08* (2013.01); *E21B 33/124* (2013.01); *E21B 43/103* (2013.01); *E21B 43/11* (2013.01); *E21B 43/25* (2013.01); *E21B 47/04* (2013.01)

(58) Field of Classification Search
CPC ..... E21B 17/00; E21B 23/00; E21B 29/08; E21B 23/02; E21B 29/002; E21B 33/124; E21B 43/25; E21B 47/04
See application file for complete search history.

(56) References Cited

U.S. PATENT DOCUMENTS

| | | | | |
|---|---|---|---|---|
| 3,020,961 | A * | 2/1962 | Orr | E21B 27/02 166/165 |
| 8,448,713 | B2 * | 5/2013 | Munshi | E21B 33/127 166/179 |
| 2002/0066578 | A1 * | 6/2002 | Broome | E21B 23/02 166/386 |
| 2003/0037930 | A1 | 2/2003 | Coon | |
| 2003/0037931 | A1 * | 2/2003 | Coon | E21B 23/06 166/387 |
| 2004/0159445 | A1 | 8/2004 | Hazel et al. | |
| 2006/0027371 | A1 * | 2/2006 | Gorrara | E21B 33/127 166/313 |
| 2006/0090903 | A1 * | 5/2006 | Gano | E21B 33/12 166/384 |
| 2007/0000664 | A1 * | 1/2007 | Ring | E21B 41/0042 166/277 |
| 2014/0076581 | A1 * | 3/2014 | Gorrara | E21B 43/103 166/380 |

FOREIGN PATENT DOCUMENTS

| | | | |
|---|---|---|---|
| GB | 2403745 | A | 1/2005 |
| WO | WO 2007/119052 | A1 | 10/2007 |

* cited by examiner

TUBULAR ASSEMBLY AND METHOD OF DEPLOYING A DOWNHOLE DEVICE USING A TUBULAR ASSEMBLY

The present invention relates to a tubular assembly for use in a wellbore of an oil, gas or water for the deployment of a downhole device. The tubular assembly can be used for deployment of downhole devices and typically provides a connection interface for the secure mounting of a downhole device in the well.

When a wellbore has been drilled into a formation, it is lined with a tubular liner (often referred to as a casing string or a liner string) which is cemented into position in order to support the wall against collapsing inwards, and to provide a conduit through which production fluids can be conveyed back to the surface. The liner is typically perforated in production zones of the wellbore, and the valuable production fluids flow from the formation through the perforations and into the wellbore for recovery from the well. A wellbore can have different production zones, and it is common to isolate them from one another using packers which radially expand to seal off adjacent production zones to allow the production of fluids from only certain zones and to contain the fluids from other zones.

The production of some zones can be stimulated by "fracturing" procedures involving the injection of fluids from the wellbore, typically through the perforations under extremely high pressure, and into the well formation. Fluids injected during fracturing procedures can comprise water, chemical stimulants, proppants, and other materials in order to encourage and stimulate the production fluids to flow from the formation into the wellbore.

According to the present invention there is provided a tubular assembly for use in a wellbore of an oil, gas or water well, the tubular assembly comprising a downhole device having a body, and a sleeve adapted to receive the body of the downhole device, wherein the sleeve is adapted for retrospective deployment into a conduit in the wellbore so that the outer circumferential surface of the sleeve is radially expanded against the inner surface of the conduit, the sleeve having a bore with an inner circumferential surface comprising an inwardly facing formation adapted to engage with an outwardly facing formation on the body of the downhole device when the body of the downhole device is disposed in the bore of the sleeve.

The conduit is typically a casing or liner cemented in place against the formation, but could be any wellbore tubing or could be tubing leading to the wellbore e.g. at or near the wellhead or riser etc before the tubing enters the formation. Optionally the conduit can be an uncased wellbore through the formation e.g. an "open hole".

The invention also provides a sleeve adapted for retrospective deployment into a conduit in the wellbore so that the outer circumferential surface of the sleeve is radially expanded against the inner surface of the conduit, the sleeve having a bore with an inner circumferential surface comprising an inwardly facing formation adapted to engage with an outwardly facing formation on a body when the body is disposed in the bore of the sleeve.

The invention also provides a method of deploying a downhole device in a wellbore, the downhole device having a body, the method comprising inserting a sleeve into the wellbore, the sleeve having a bore adapted to receive the body of the downhole device, the bore having an inner circumferential surface comprising an inwardly facing formation adapted to engage with the body of the downhole device, and the sleeve being radially expandable, wherein the method includes the steps of: radially expanding the sleeve whereby the outer circumferential surface of the sleeve engages the inner surface of the conduit; and inserting the body of the downhole device into the radially expanded bore of the sleeve such that the outwardly facing formation on the body of the downhole device engages the inwardly facing formation of the inner circumferential surface of the sleeve.

The sleeve is preferably formed of a ductile/expandable material such as metal and more preferably provides a device that can be retrofitted to an existing bore and used to either provide an internal surface that can be sealed against and/or can be used to subsequently bear an axial load such that a tool or other device can be subsequently run into the well at a later time and can be connected or otherwise coupled to the sleeve (and optionally may be sealed thereto) such that the sleeve can bear the axial loading provided or exerted by that tool or other device.

Optionally the whole of the sleeve can be radially expanded into contact with the conduit, typically by applying fluid pressure to the inner surface of the sleeve, but in some embodiments of the invention only certain annular portions of the sleeve are expanded; typically two axially spaced annular portions of the sleeve are expanded, optionally located at opposite ends of the sleeve.

Optionally the sleeve is not uniformly expandable and comprises at least one hyper-expandable region that is adapted to expand more than other regions, typically because it is formed of a weaker material and/or because it has a particular structural configuration (e.g. slots or thinned walls, or other weakening formations) to facilitate greater expansion of the hyper-expandable region as compared to other regions of the sleeve when subjected to the same radial expansion force.

The sleeve may have more than one hyper-expandable region and if so, the two hyper-expandable regions may be spaced apart axially along the sleeve.

Optionally the sleeve comprises first and second axially spaced hyper-expandable regions, which are typically adapted to be relatively easily radially expanded, and a central region, typically located between the first and second axially spaced hyper-expandable regions, which is relatively more adapted to resist radial expansion than the first and second axially spaced hyper-expandable regions, whereby when a radial expansion force is applied to the sleeve, the first and second axially spaced hyper-expandable regions expand radially to a greater extent than the central region. Typically the first and second axially spaced hyper-expandable regions are disposed at or near respective ends of the sleeve.

Typically the inwardly facing formation on the sleeve is disposed on the central region.

The inwardly facing formation on the sleeve can optionally comprise an annular surface. This can be provided by the inner circumferential surface or can extend from the inner circumferential surface.

The inwardly facing formation can optionally comprise a profile which extends radially inwards from the inner circumferential surface of the sleeve.

The inwardly facing formation can include a polished surface or a seal-receiving recess.

The inwardly facing formation can optionally include a reinforced region adapted to deform to a different extent (i.e. to a lesser extent) when subjected to radial expansion forces than other region(s) which may be hyper-expandable region(s).

Optionally the inwardly facing formation can be a shoulder, shelf or lip profile protruding radially into the bore of the sleeve. The inwardly facing formation can be annular and can extend all of the way around the inner circumference of the sleeve, or can extend only partially around the inner circumference.

The outward facing formation on the downhole device typically extends radially outward from the downhole device towards the formation on the sleeve.

Optionally a seal device can be provided between the downhole device and the sleeve. The downhole device can comprise a radially expandable seal, adapted to pass through the sleeve in a first non-expanded configuration, and adapted to seal in the bore of the sleeve in a second radially expanded configuration.

Optionally the assembly can be used in wellbore operations to produce fluids from a particular zone, or to inject fluids into a particular zone. In one such embodiment, a single sleeve can be deployed between two zones of a wellbore, and can be radially expanded into contact with the wellbore wall to set the sleeve in place, and thereafter a work string carrying a packer or a sealstem can be inserted into the bore of the sleeve, so that the packer is deployed to set within the bore of the sleeve, typically on the central region of the sleeve, whereby the inwardly facing formation on the sleeve engages the seals on the packer. The inwardly facing formation in this case can be a polished annular surface such as a Polished Bore Receptacle (PBR) adapted to create an effective seal with the packer or sealstem and also able to withstand the radial forces applied by the packer when it sets in the sleeve, so that the packer sets and isolates the two zones from one another, allowing both to be produced separately from one another, or allows one to be produced and not the other.

In another embodiment, two or more sleeves are deployed in axially spaced apart locations in the wellbore, and a work string with two packers or sealstems similarly spaced is deployed within the bore of the sleeve, so that the two packers set within the bore of the respective sleeves. The inwardly facing formations on the sleeves assists the packers in providing a good seal against fluid passing the packers, and the double packer and sleeve arrangement effectively isolates the zone between the packers. This can be used to isolate a zone with an unacceptably high water cut in the produced fluids. Alternatively the respective packers can optionally be set above and below a perforated section of the wellbore, and the work string between the packers can be provided with at least one port for injection of stimulation fluids for fracturing treatments of the zone between the two packers.

Optionally the sleeves can be set at any location in the wellbore, after the wellbore has been deployed and cemented in place, so the packer or other downhole device can therefore be set at any location in the wellbore where a sleeve can be deployed.

Typically the sleeve is disposed in the bore of the well at the desired location and is radially expanded by an expander device that is deployed within the bore of the sleeve, either at the same time as the sleeve is deployed or after the sleeve has been deployed. The expander device can apply radial expansion forces as a result of hydraulic pressure, e.g. by pressurised fluid applied between the expander device and the sleeve. However, in certain embodiments, the radial force can be applied by a mechanical expander device.

Radial expansion force applied by the expander device causes the sleeve to move radially outwardly to bear against the inner surface of the wellbore in which it is located.

The radial force pressing the sleeve outwards is typically effective to fix the sleeve in place and allows it to resist axial forces applied to the sleeve after expansion, for example axial forces applied to a string bearing a packer that is set on the sleeve.

After the sleeve has been radially expanded by the expander device, the expander device is typically de-activated, and reduces in radial diameter and is then withdrawn axially from the bore of the sleeve, and is typically recovered to surface. After the expander device has been removed from the bore of the sleeve the downhole device is then typically inserted into the bore of the sleeve to engage the sleeve.

Typically, one or more sleeve(s) is/are inserted into the wellbore to the required depth, and can typically be deployed by wireline, coil tubing or drill pipe.

The sleeve is typically radially expanded to such an extent that the sleeve plastically deforms and retains its expanded configuration after the radial expansion force is removed from the sleeve. The sleeve is typically formed from a suitable metal material, such as steel or an alloy material, which is adapted to expand radially when subjected to the appropriate radial force of the expander device. The radial force (e.g. the hydraulic pressure) used to expand the sleeve can typically be increased until the wellbore, casing, liner or tubing is elastically and plastically deformed. When the pressure is removed there is typically a residual interface pressure between the wellbore, casing, liner or tubing and the sleeve.

The sleeve may be provided with a coating such as an elastomeric coating and/or a non-uniform outer surface such as a ribbed, grooved or other form of surface, in order to increase the effectiveness of the seal between the sleeve and the wellbore when the sleeve is radially expanded against the wall of the wellbore. Seals between the sleeve and the wellbore may comprise metal to metal seals or elastomeric seals and may be provided in the form of a band or a ring.

Optionally, the engaging faces of the sleeve or the wellbore may be provided with a surface that facilitates grip between the sleeve and the wellbore, and the said surface may comprise one or more recesses, coatings or non-uniform surfaces such as grooves, ribs or the like. This has the advantage of increasing the resistance to lateral movement occurring between the sleeve and the wellbore preventing the sleeve from being pushed down or pulled out of the wellbore.

Typically, the downhole device is located co-axially within the sleeve.

Typically, the depth and diameter of the sleeve and the downhole device at any given time can be monitored and optionally recorded by either downhole instrumentation or surface instrumentation.

The downhole device can optionally incorporate a plug device.

The downhole device can incorporate a cutting device, which can optionally be used to cut tubing forming the conduit below the sleeve. The downhole device can optionally be set within the sleeve before the cutting operation, so that the sleeve remains connected to the cut upper portion of the tubing after the cutting operation, so allowing the retrieval of the cut upper portion of the tubing by axially retrieving the cutting tool string which remains attached to the cut upper portion.

The downhole device or the sleeve can optionally incorporate a depth location device such as an RFID tag or pressure sensor. The depth location device typically reports and optionally records the depth of the sleeve or the body to a sensor which can be local or located in the surface equipment.

Different kinds of downhole device can be landed in the sleeve after it has been deployed as long as a suitable formation on the downhole device can engage with the formation on the sleeve. Therefore, the sleeve represents a modular anchoring or landing point in the wellbore that can be retrospectively set in the conduit at numerous desired locations as they are needed, or in anticipation of such a need in the future, and the different downhole devices (velocity strings, packers, liner strings, plugs, facture treatment strings etc) can then be deployed easily into the sleeves at predicted and measured depths and a good physical connection can be made in the sleeve to secure the device in place without being concerned about the condition of the underlying conduit radially outward of the sleeve. As the sleeve can incorporate sealing and other formations, the downhole device landed into the sleeve can optionally be sealed into place with more certainty and longevity than is currently possible using packers deployed into the existing conduit. The physical connection between the sleeve and the body also helps the resistance to axial movement that can occur when packers are simply set in place in ordinary conduit. This enables high pressure operations to be carried out more reliably.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention.

Various embodiments and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including", "comprising", "having", "containing", or "involving", and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa.

All numerical values in this disclosure are understood as being modified by "about". All singular forms of elements, or any other components described herein are understood to include plural forms thereof and vice versa.

Embodiments in accordance with the present invention will now be described, by way of example only, with reference to the accompanying drawings, in which:—

Figure 9:
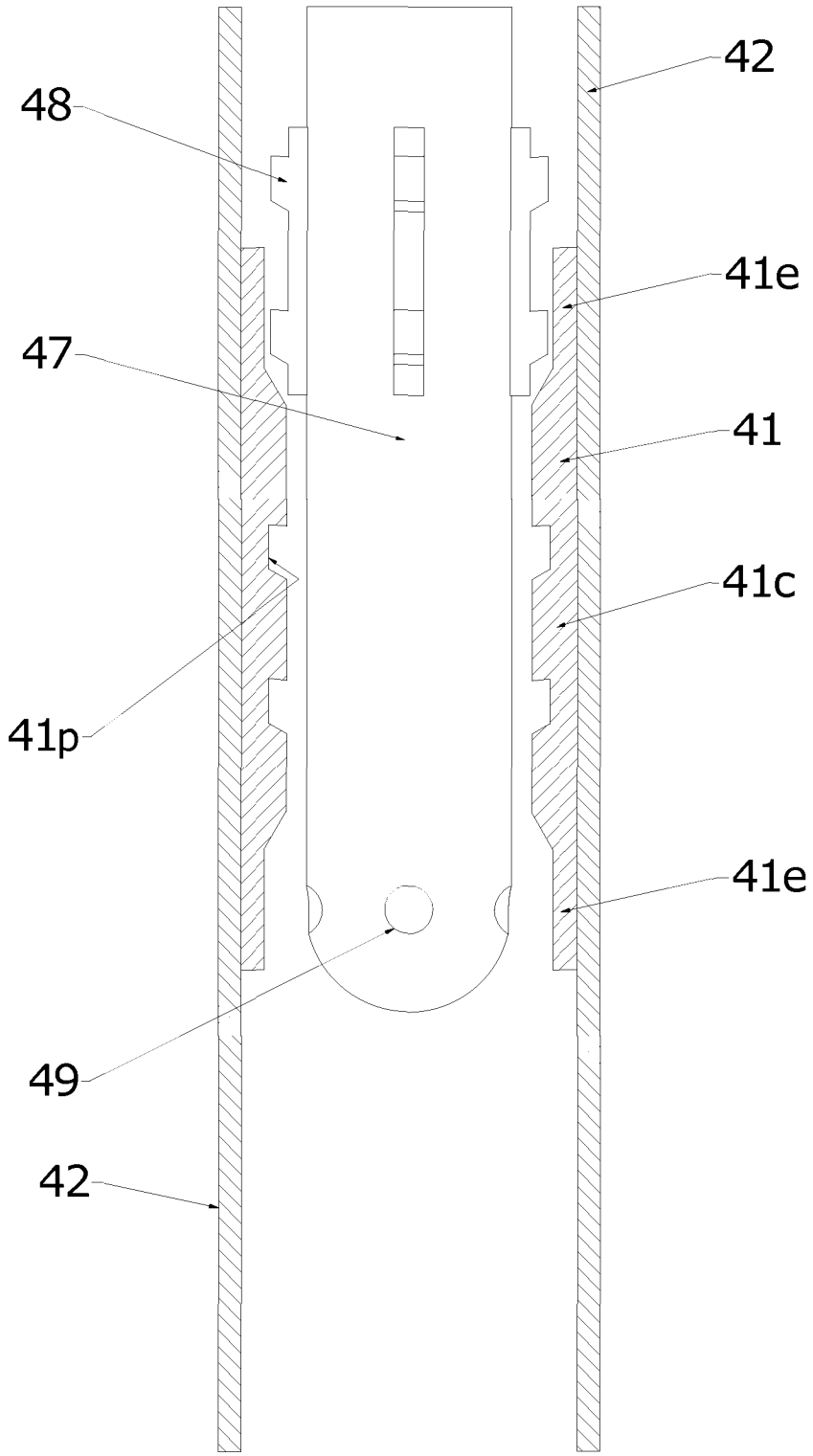
Figure 10:
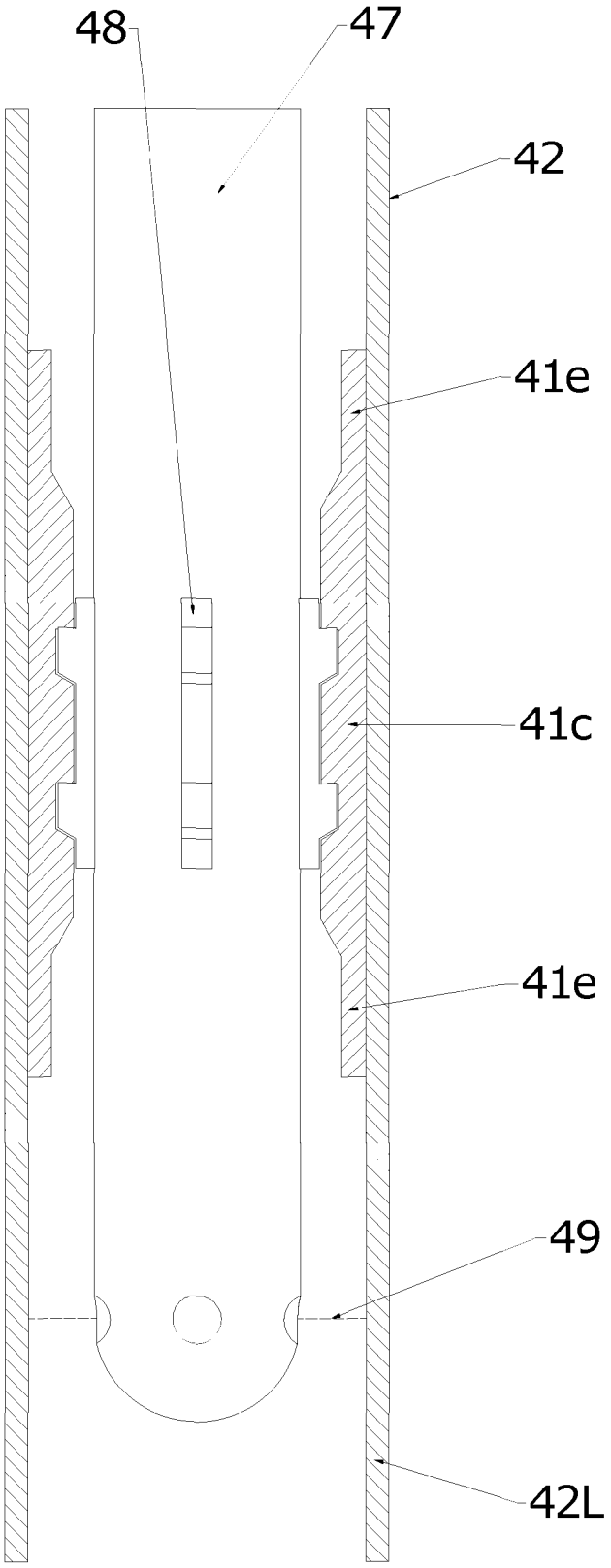
Figure 11:
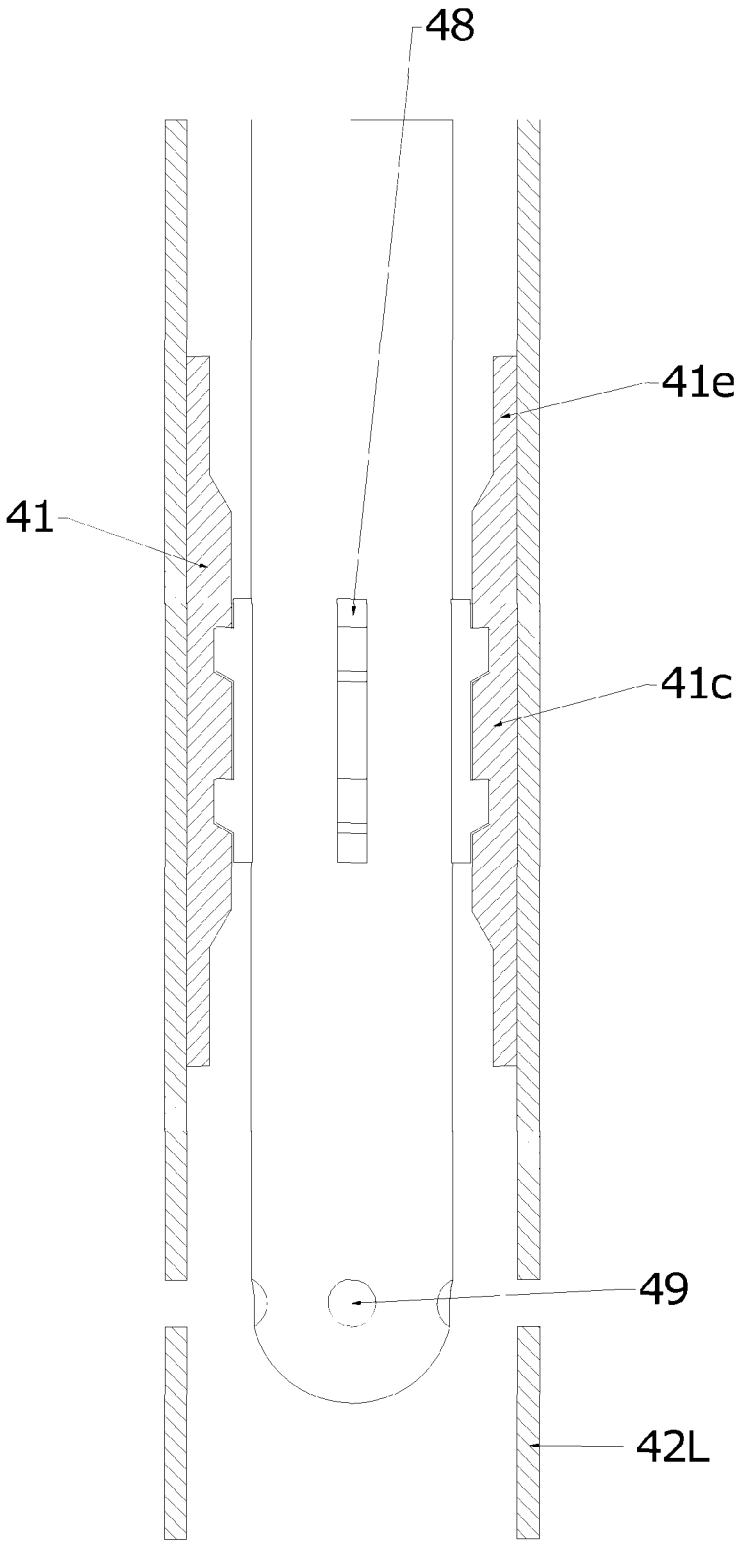

FIGS. 9-11 are sequential schematic side views of a fourth embodiment of a tubular assembly in accordance with the present invention comprising a cutting tool, wherein the tubular assembly is being used to secure the cutting tool at the designated depth, and to recover the cut upper section of conduit from the well after the cutting operation has been completed; and FIGS. 12-15 are sequential schematic side views of a fifth embodiment of a tubular assembly in accordance with the present invention being used to install a liner inside the conduit.

Figure 1:
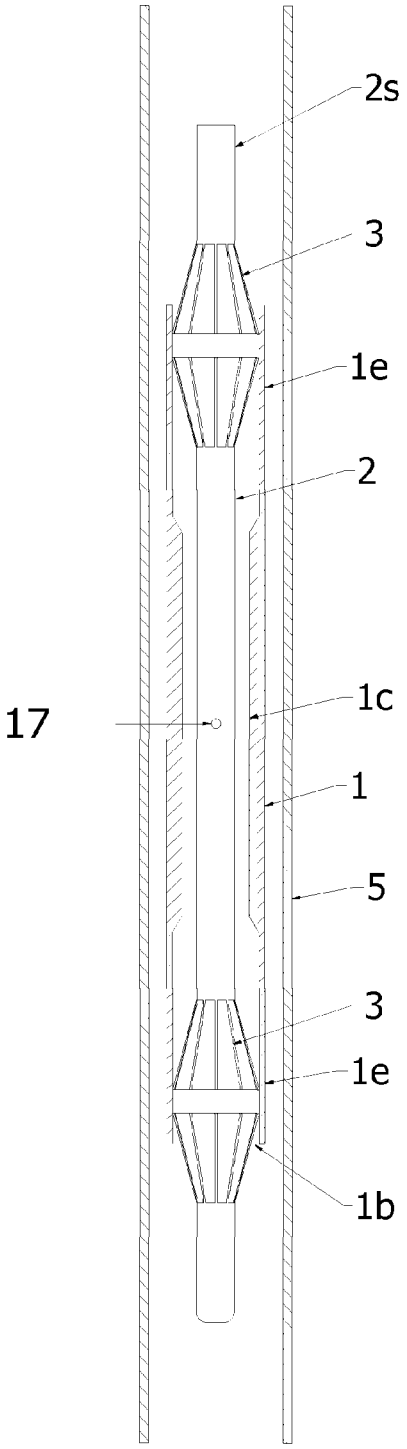
FIG. 1 is a schematic side view of a first embodiment of a tubular assembly in accordance with the present invention in the form of a sleeve of a tubular assembly, being conveyed through a liner on an expander device to a location at which it will be operated.

Referring now to the drawings, FIG. 1 shows a sleeve 1 used in a first embodiment of a tubular assembly being run into a liner 5. The sleeve 1 has a bore 1*b* which receives an expander tool 2 coaxially in the bore. The expander tool 2 comprises upper and lower expandable seals 3 of known design which mechanically expand in order to seal against the inner surface of the sleeve 1. The expander tool 2 is typically a Hydraulic Expansion Tool System (HETS™) offered by Read Well Services Ltd of Aberdeen, UK as disclosed in U.S. Pat. No. 7,017,670 plus other patents but other suitably adapted expander tools could also be used. The sleeve 1 is connected to the expander tool 2 in its initial unexpanded configuration shown in FIG. 1 and is run into a casing, liner or tubing 5 or into an unlined borehole (not shown) by means of tool string 2*s* connected to the upper end of the expander tool 2. The tool string 2*s* could be coiled tubing or drill pipe, or some other suitable conveyance means. The sleeve 1 is generally tubular in shape.

Figure 2:
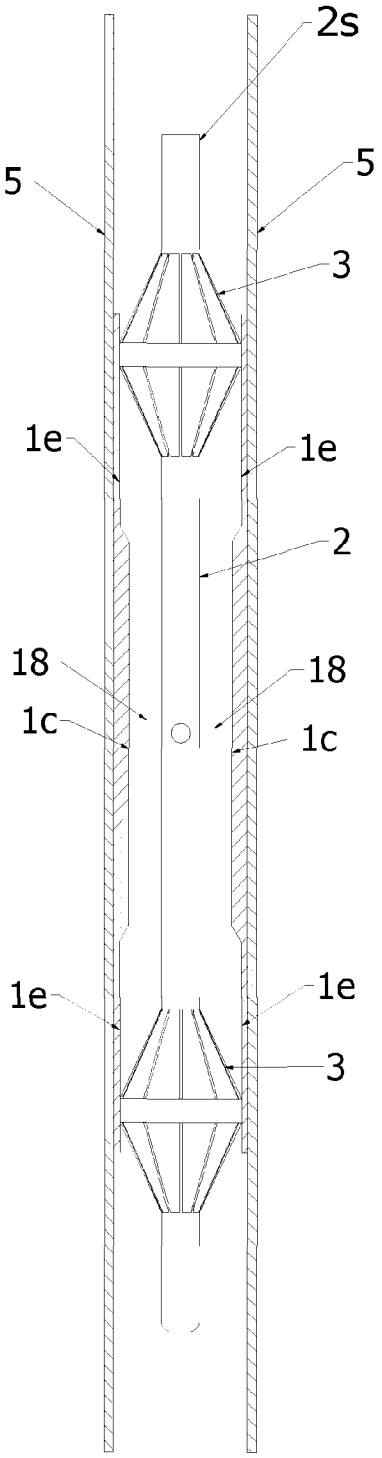
FIG. 2 is a schematic side view of the assembly of FIG. 1 being radially expanded in a desired location in the liner.

When the expander tool 2 is operated, very high pressure hydraulic fluid (not shown) is typically pumped out of the expander tool 2 through ports or apertures 17 into the annular chamber 18 between the tool 2 and the sleeve 1, and the very high pressure hydraulic fluid acts against the inner surface of the sleeve 1 in between the upper and lower seals 3 and expands the sleeve radially from its initial unexpanded configuration shown in FIG. 1 to a radially expanded configuration shown in FIG. 2, in which substantially all of the outer surface of the sleeve 1 has been pressed against the inner surface of the liner 5.

Figure 3:
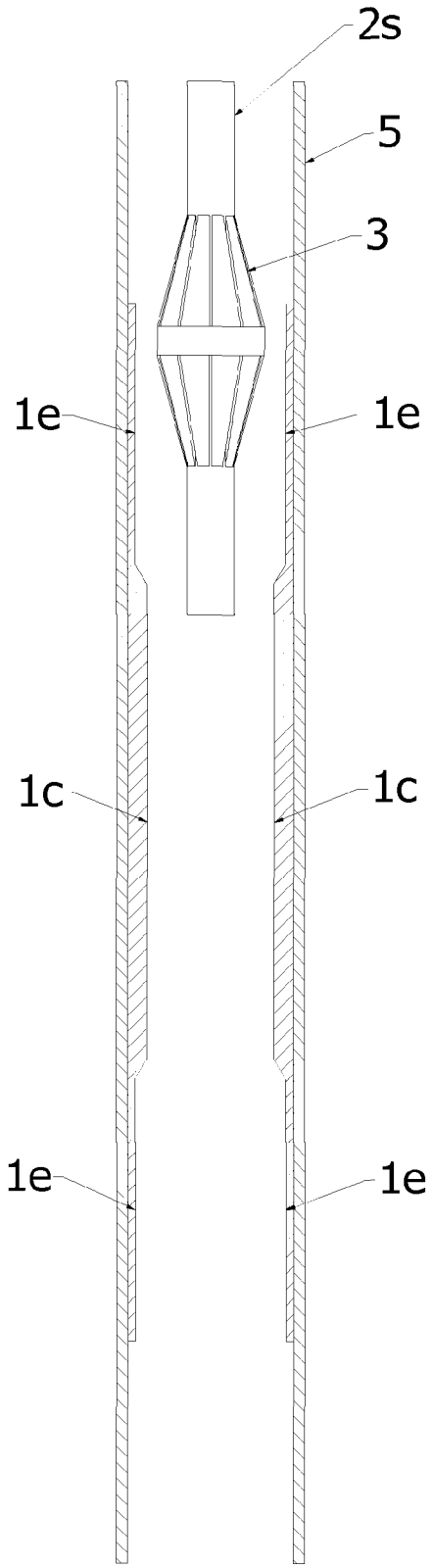
FIG. 3 is a schematic side view of the FIG. 1 assembly after radial expansion of the sleeve, when the expander device is being withdrawn from the bore of the sleeve.

The radial expansion force applied by the hydraulic fluid chamber 18 is sufficient to plastically deform the sleeve 1, so that when the radial force is removed by removal of the high pressure fluid and collapse of the expandable seals 3 (as shown in FIG. 3), the sleeve 1 remains radially expanded and engaged with the liner wall. The radial force applied by the hydraulic fluid also presses the sleeve 1, against the wall of the liner 5 with sufficient force that axial movement of the sleeve 1 relative to the liner 5 is prevented after the radial expansion force applied by the tool 2 has been removed, even if considerable axial force is applied to the sleeve 1. Optionally, the outer surface of the sleeve 1 and/or the inner surface of the liner 5 can have keying formations that interengage to assist in resisting axial sliding of the two components once the sleeve 1 has been expanded radially.

After the sleeve 1 has been radially expanded past its threshold of elastic deformation so that the sleeve 1 is plastically deformed and retains its expanded configuration, the expander tool 2 is collapsed and withdrawn from the bore of the sleeve 1 leaving the expanded sleeve 1 secured in place against the inner wall of the liner 5. The expander tool string 2*s* is withdrawn to surface and a new tool string is then run into the hole, which contains a downhole tool adapted to engage with the sleeve 1.

In the first embodiment, the sleeve 1 is shown as having a central region 1*c* with a thicker wall diameter than the end sections 1*e*, which have a thinner diameter of wall thickness but the difference is exaggerated in the figures and in actual practice, there may only be a minimal difference or indeed there may be no difference at all such that the central region 1C and the end sections 1*e* have the same diameter. The sleeve is typically made of a single piece of metal by rolling or casting etc. The reinforced central section 1*c* of the sleeve 1 is optionally more or less resistant to radial expansion than the end sections 1*e*, which have thinner walls but could have thicker walls and which are therefore respectively easier or harder to expand radially. In the embodiment shown the amount of expansion of the sleeve 1 is constant along its length, but optionally the central section 1*c* can radially expand differently (i.e. more or less) than the end sections 1*e*.

The inner surface of the central section 1*c* can either be smooth or polished such that it provides, after expansion, a Polished Bore Receptacle (PBR) which seals 8 can seal against (as will be described subsequently in terms of a fracturing operation) or a profiled surface against which tools can be latched/locked (as will also be described subsequently).

Figure 4:
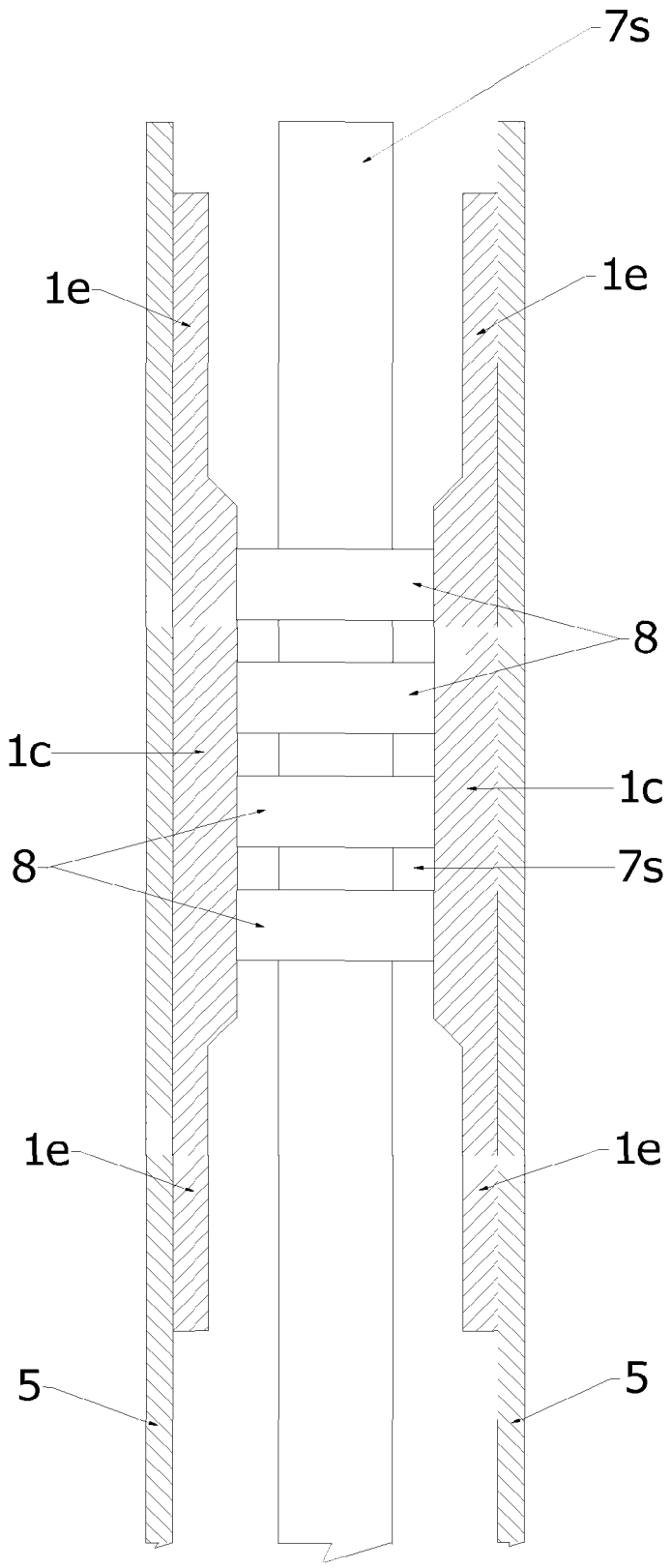
FIG. 4 is a schematic side view of the FIG. 1 sleeve after a downhole device has been deployed into the bore of the expanded sleeve and has engaged with the sleeve.
Figure 5:
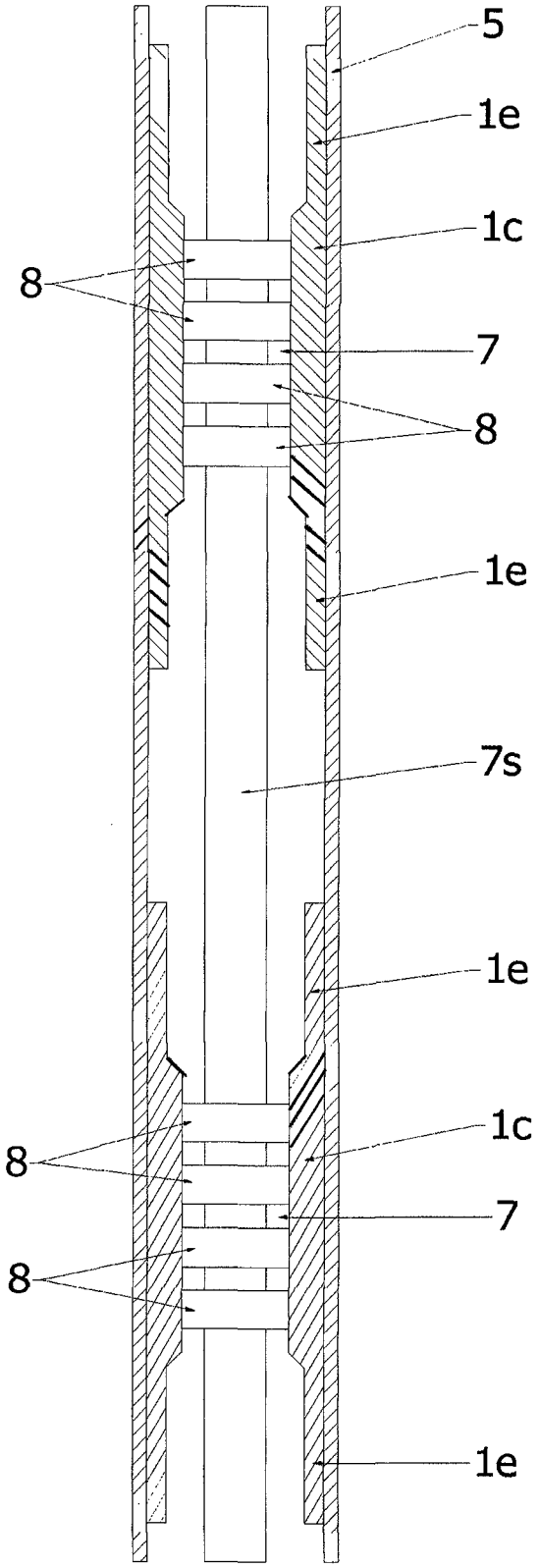
FIG. 5 is a schematic side view of two of the sleeves of the FIG. 1 assembly being used during a multiple zonal isolation fracturing operation.

A sealing downhole tool in the form of an annular packer 7 (as shown in FIGS. 4 and 5) is provided on or toward the end of a second work string 7*s*, and is run into the bore of the well on the work string 7*s* until the packer 7 has entered the bore of the radially expanded sleeve 1. The packer 7 has a number of seal members 8 facing radially outwards from the packer; the seal members 8 are typically arranged circumferentially to engage the polished bore receptacle provided by the inner wall of the central region 1*c* of the expanded sleeve 1 and close off the bore. The inner surface of the central region 1*c* of the expanded sleeve 1 has a smooth and optionally a polished surface adapted to create a high pressure seal with the sealing members 8 of the packer 7. Optionally the inner surface could have seal receiving recesses (not shown) adapted to receive individual seal members 8.

Once the packer 7 has been run into the bore of the sleeve 1 it is radially expanded to push the seal members 8 against the smooth polished inner surface of the central region 1*c* of the sleeve, and a high pressure seal is created as a result. Typically more than one seal member 8 is provided in the axial stacked arranged shown in FIG. 4, e.g. 2, 3, 4, 5 or more annular seals can be provided. As well as creating a seal that resists the passage of fluids across the expanded packer 7, the seal members 8 grip the sleeve 1 to provide resistance to axial movement of the packer 7 relative to the sleeve 1, which is in turn secured to the wall of the liner 5. Thus the packer 7 optionally anchors the string 7*s* axially in the bore of the sleeve 1 and prevents relative movement between the string 7*s* and the liner 5. Once the packer 7 has been expanded, the zones above and below the packer 7 can be produced independently of one another.

FIG. 5 shows a variant of the FIG. 4 arrangement, in which more than one packer 7 is provided in the string, each landing into a respective sleeve 1. In the FIG. 5 embodiment, two sleeves 1 are provided and are axially spaced apart on the inner surface of the liner 5. The FIG. 5 arrangement allows three zones to be isolated and produced independently, one zone above the upper packer, one between the two packers, and one below the lower packer. More than two sleeves and packers can be provided, and each packer lands in a separate sleeve.

Figure 6:
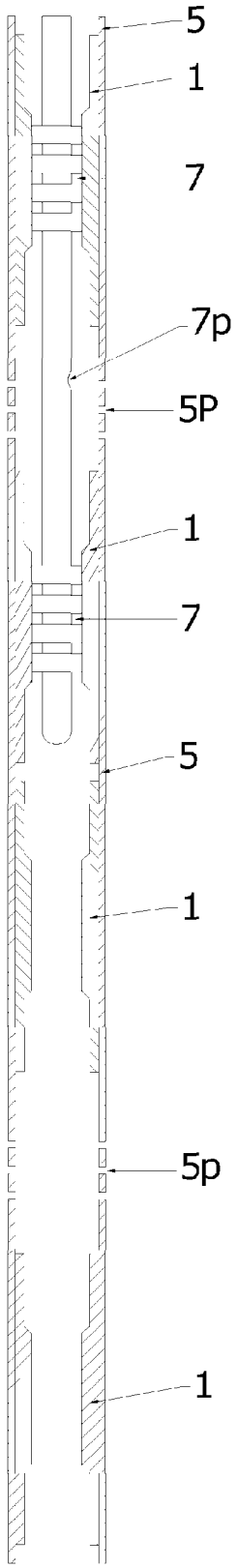
FIG. 6 is a schematic side view of a further two sleeves as shown in FIG. 1 being used in addition to the FIG. 5 assembly being used during a fracturing operation.

FIG. 6 shows a further variant of the FIG. 5 variant. In the FIG. 6 variant, four sleeves 1 have been previously expanded into place on the inner surface of the liner 5. Between adjacent sleeves the liner is perforated at 5*p*. The liner string 7*s* has a port 7*p* between two adjacent packers, and when the packers 7 are landed on the upper sleeves 1 set in the inner surface of the liner above and below the upper perforations 5*p*, the packers 7 can be set to isolate the upper perforations 5*p* from the rest of the liner. The port 7*p* on the packer string can then be used to inject well formation stimulants from the inner bore of the packer string 7*s*, through the port 7*p*, into the annular space between the packer string 7*s* and the liner 5, and through the perforations 5*p* into the formation. This can be useful in fracture treatments of the well formation. The arrangement of this embodiment is less sensitive to the usual problems which arise as a result of the very high pressure at which such procedures are carried out. The arrangement of this embodiment is typically less prone to axial slipping or other failure of the packers, as the packer sealing members 8 are landed on the polished and reinforced inner bore of the central region Ic, and are therefore more likely to sustain a good hydraulic seal against fluid escape, and also a good physical axial anchor against slippage.

Figure 7:
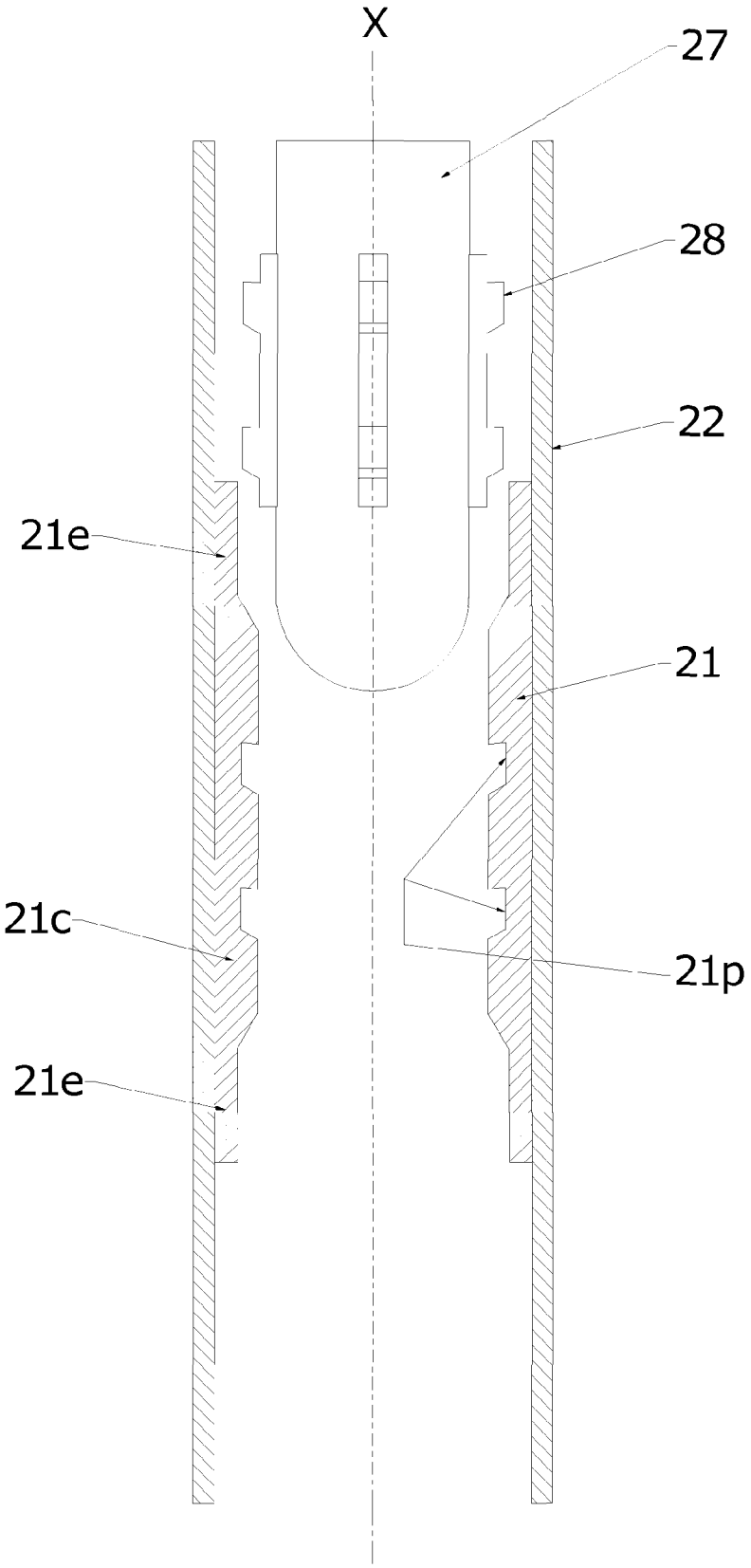
FIG. 7 is a schematic side view of second embodiment of a tubular assembly in accordance with the present invention being used during a depth corroboration operation.

FIG. 7 shows a second embodiment of the tubular assembly. In the second embodiment, similar reference numbers are used for components that are similar to those of the first embodiment, but are prefixed by 2. In the second embodiment, the sleeve is used to land a downhole device in the form of a depth corroboration device 27. The sleeve 21 is expanded into the inner surface of the liner 22 in the same way as previously described, and the inner surface of the sleeve 21 has a central section 21*c* that is thicker than the relatively thinner end sections 21*e*. However, in the second embodiment, the central section 21*c* is not smooth on its inner surface but instead is provided with formations in the form of two annular recesses 21*p* which run parallel to one another around the inner circumference of the surface of the sleeve 21. The recesses 21*p* do not extend perfectly radially perpendicular to the axis x of the bore of the sleeve 21, but instead the radially inner open ends of the recesses are angled down the bore. The inner openings of the recesses 21*p* extend radially inwardly and are adapted to receive matching profiled formations 28 on the body of the depth corroboration device 27, which engage in the recesses 21*p* to provide an axial stop and resistance to axial upward pull, permitting the operator to verify that the formations 28 on the body 27 are engaged securely in the angled recesses 21*p* on the sleeve 21, thereby allowing physical confirmation of the depth.

Figure 8:
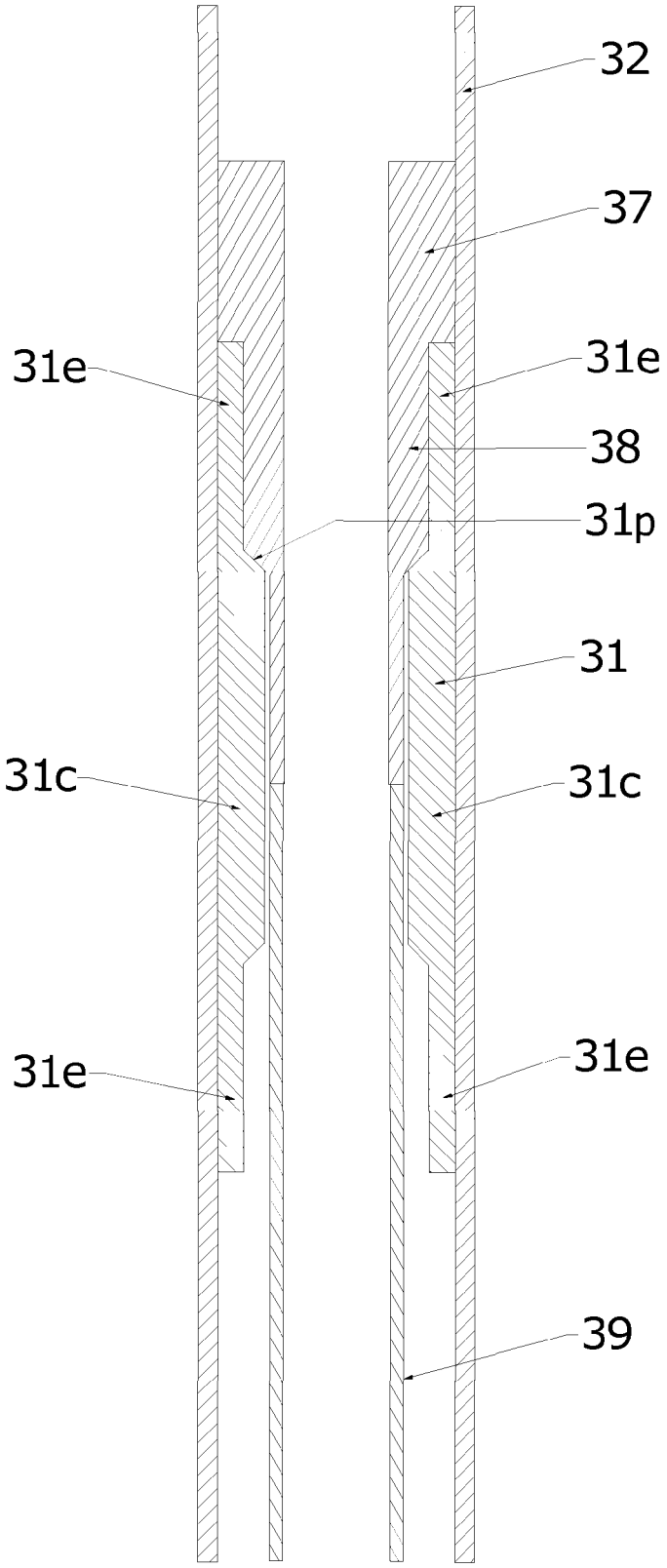
FIG. 8 is a schematic side view of third embodiment of a tubular assembly in accordance with the present invention being used to install a liner inside the conduit.

FIG. 8 shows a third embodiment of the tubular assembly. In the third embodiment, similar reference numbers are used for components that are similar to those of the first embodiment, but are prefixed by 3. In the third embodiment, the sleeve 31 is used to land a downhole device in the form of a liner hanger device 37, used to suspend a length of smaller diameter liner 38 within the bore of the larger diameter casing or liner 32. The sleeve 31 is expanded into the inner surface of the liner 32 in the same way as previously described, and the inner surface of the sleeve 31 has a central section 31*c* that is thicker than the relatively thinner end sections 31*e*. However, in the third embodiment, the central section is provided with at least one (typically more than one) formation in the form of an upwardly facing shoulder 31*p* around the inner circumference of the surface of the sleeve 31. The shoulder 31*p* faces inwardly and is adapted to engage with a matching profiled shoulder 38 on the outer surface of the body of the liner hanger device 37, which engages with the shoulder 31*p* to provide an axial stop and resistance to axial downward force, permitting the operator hang the liner 39 from the hanger 37 securely located at a precise depth in the larger diameter liner 32. The upper surface of the sleeve 31 also provides an annular shoulder to engage with a matching profile of the liner hanger 37.

The sleeve of any embodiment can be set at many different locations at the choosing of an operator either when the well is being completed and the liner is being installed with the sleeve preset in a defined location, or alternatively the sleeve can be installed later into a pre-existing liner (i.e. "retrofitted") again at a location of the operator's choosing, with less regard for the physical condition and underlying structure of the liner at the desired location, since the forces during setting and use are mainly borne by the sleeve rather than the liner.

Referring now to FIGS. 9-11, a fourth embodiment will be described. In the fourth embodiment, similar reference numbers are used for components that are similar to those of the previous embodiments, but are prefixed by 4. In the fourth embodiment, the sleeve 41 is used to land a downhole device in the form of a cutting device 47, used to cut an upper length of liner 42 which is to be replaced. The sleeve 41 is expanded into the inner surface of the liner 42 in the same way as previously described, and the inner surface of the sleeve 41 has a central section 41*c* that is thicker than the relatively thinner end sections 41*e*. However, in the fourth embodiment, the central section is provided with at least one (typically more than one) formations in the form of recessed profile 41*p* around the inner circumference of the surface of the central section 41*c* of the sleeve 41. The recessed profile 41*p* faces radially inwardly and is adapted to engage with at least one (typically more than one) matching profiled axial rib 48 extending radially outwardly from the outer surface of the body of the liner hanger device 47, which engage with the recessed profile 41*p* to provide an axial stop and resistance to axial downward and upward force. The rib 48 can be annular if desired. Once the cutting tool 47 is located in the bore of the sleeve 41, the formations engage as shown in FIG. 10 to fix the position of the cutting tool 47 relative to the liner 42. Then the operator operates the cutter jets 49 and cuts the upper section of the liner 42 at a precise depth and angle, because of the inter-engagement of the formations on the sleeve and the downhole device. Once the cutting operation has been completed, as shown in FIG. 11, the cut upper section of the liner 42 above the cut can be lifted out of the hole by withdrawing the cutting tool string, thereby leaving a lower section of liner 42L in the well.

Figure 12:
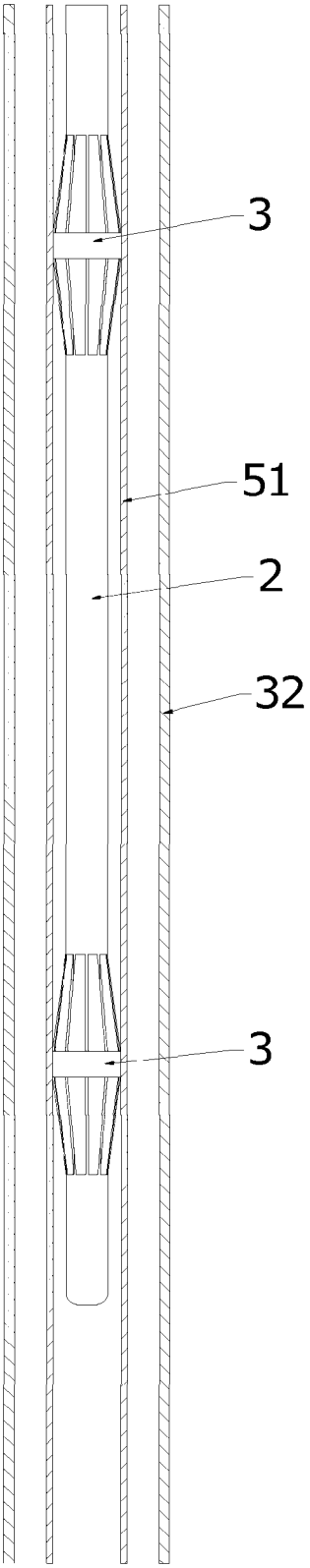

FIG. 12 shows a fifth embodiment of the tubular assembly. In the fifth embodiment, similar reference numbers are used for components that are similar to those of the previous embodiments, but are prefixed by 5. The fifth embodiment comprises a sleeve 51 which is run into a wellbore having liner 32 already installed therein, where the sleeve 51 is run into the cased wellbore on an expansion tool 2 in a similar manner to the embodiments previously described (particularly the third embodiment of FIG. 8). The sleeve 51 is expanded into the inner surface of the casing or liner 32 in the same way as previously described (particularly the third embodiment of FIG. 8) and, after expansion and as to be subsequently described, the sleeve 51 will provide a shoulder profile 52 which can subsequently be used to land a liner hanger device 53 (run into the well on a subsequent, separate running in hole operation) such as a velocity string (used to provide additional lift to hydrocarbons such as gas in a well) or a tail pipe (not shown) or the like.

Figure 13:
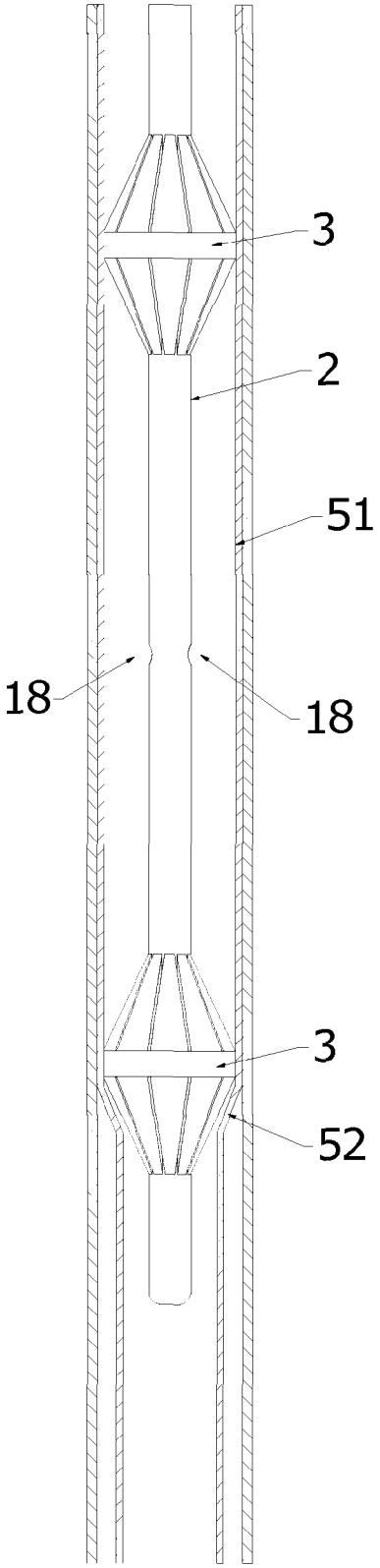
Figure 14:
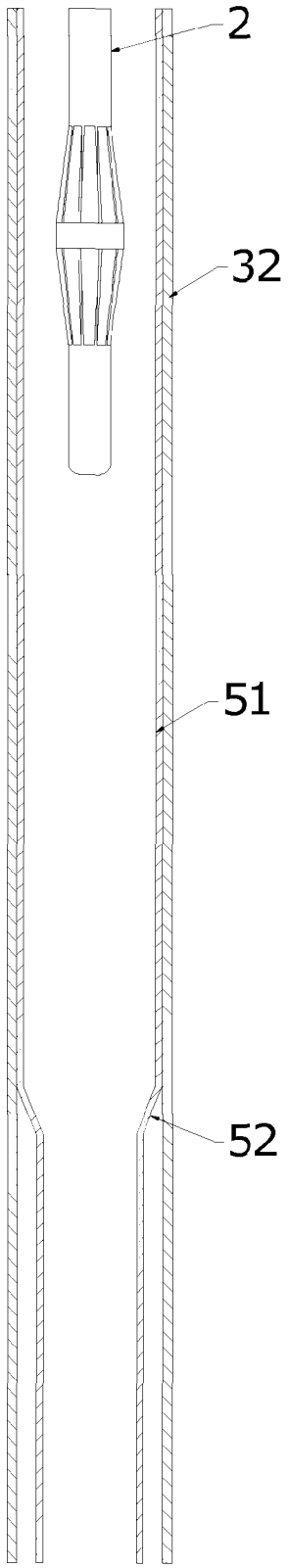
Figure 15:
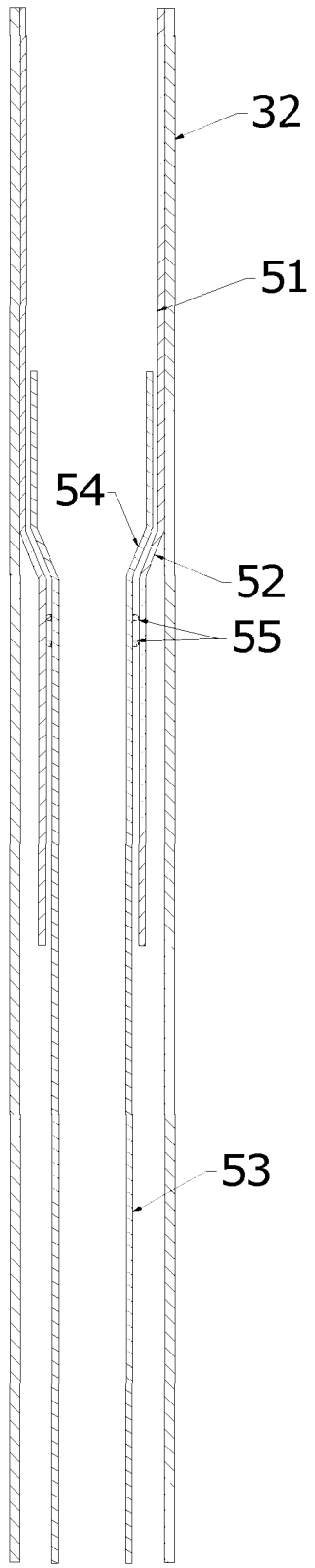

As can be seen in FIG. 13, the expansion tool 2 is operated as previously described (particularly the third embodiment of FIG. 8) such that the seals 3 are energised and the hydraulic fluid is pumped under pressure in the annular chamber 18 from the apertures in the expansion tool 2 to radially expand the sleeve 51. However, as also shown in FIG. 13, the sleeve 51 is longer than the axial distance between the upper and lower seals 3 and the sleeve 51 is mounted on the expansion tool 2 such that the lower end of the sleeve 51 extends down past the lower seal 3 such that an overhang is also provided and therefore a tapered section forming a radially inwardly extending shoulder 52 is formed in the sleeve between the expanded portion and unexpanded lower end portion of the sleeve 51 such that the tapered portion 52 forms an internally projecting shoulder 52. As shown in FIG. 14, the expander tool 2 is then deactivated such that the seals 3 are de-energised and radially retracted and the expander tool 2 is then removed from the well, leaving the expanded sleeve 51 in place. Thereafter, a liner hanger 53 such as a liner hanger 53 for a velocity string (i.e. a relatively small diameter conduit for tubing used to provide additional lift in a well) can thereafter be run into the well on a separate running in operation such that a shoulder 54 provided at the upper end of the liner hanger 53 will land into and rest upon the internally projecting shoulder 52 of the sleeve 51. Seals 55 optionally provided on the outer surface of the liner hanger 53 typically provide a seal between the outer circumference of the liner hanger 53 and the inner circumference of the sleeve 51 to avoid unwanted gas or liquid passing between the two components 51; 53. Consequently, the sleeve 51 can bear the axial load or weight of the liner hanger 53 and any string connected to its lower end up to the rated axial loading of the sleeve 51.

Embodiments of the invention allow the sleeve to morph from one shape to another, usually expanding in response to hydraulic fluid pressure so that the diameter increases, allowing the sleeve to pass through a relatively small diameter bore in a small diameter configuration, and then once in place, the sleeve can be expanded to be set in a larger diameter bore.

Embodiments of the invention provide a morphable tubular assembly that can be used in a gas, oil or water well for the deployment of a device or connection interface at any depth in an existing wellbore, in cased hole or open hole, passing through a restriction prior to being activated. The assembly can be used to provide anchoring points in one or multiple locations in a wellbore, or to provide seal bores for suitably sized packers or sealstems in one or more locations in the wellbore. Certain embodiments provide and anchoring and sealing support for a velocity string or similar hanging device. Some embodiments can be used to hang a downhole sensor such as a pressure gauge in a suitable location in the wellbore. The assembly can typically pass through a smaller diameter before being morphed to seal and anchor in a larger diameter. Typically the morphable assembly can adapt the final pressure used to secure the assembly in position to the strength and condition of the wellbore or other tubular where it is being set, so that in weak or damaged tubular it can still be set without damaging the existing well structure. The morphable sleeve is typically deployed on a tool and located in the correct position in a wellbore. The tool or device deployed in the sleeve typically has a seal means to contain and control the pressure used to morph the assembly in position. Typically the assembly can have a pressure generator, or a supply of pressurised fluid (gas or liquid) for generating hydraulic pressure. Certain embodiments can be deployed on wireline, coiled tubing or drill pipe. In some cases, the entire assembly can be expanded, or only the part that is used to secure it in position in the wellbore. The assembly can optionally include a latching profile that can be used for hanging a device, or locating a device in a particular desired position in the well. The profile could be used to locate a cutting device in the correct position, and the cutting device could cut the tubular below the profile allowing the cut section of tubular to be withdrawn from the well together with the cutting device.

Modifications and improvements may be made to the embodiments without departing from the scope of the invention. For instance, the packer tool 7 of FIG. 4 can optionally comprise a plug. Setting could be via hydraulic or mechanical means. Final setting loads of all seals could vary, depending on the differential pressure requirements. These final setting loads could be set via either a mechanical shear device when set mechanically or via final hydraulic pressure when set with hydraulics. For retrieval of the plug, the seals could be de-activated via releasing the hydraulic pressure or by releasing the ratchet/slip mechanism.

We claim:

1. A tubular assembly for use in a wellbore of an oil, gas or water well, the tubular assembly comprising a downhole device having a body, and a sleeve adapted to receive the body of the downhole device, wherein the sleeve is adapted for retrospective deployment into a conduit in the wellbore so that the outer circumferential surface of the sleeve is radially expanded, by applying fluid pressure to an inner circumferential surface of the sleeve, against an inner surface of the conduit, the sleeve having a bore with the inner circumferential surface comprising an inwardly facing formation adapted to engage with an outwardly facing formation on the body of the downhole device as the body of the downhole device is disposed in the bore of the sleeve, and wherein said sleeve is not in a state of axial compression when said sleeve is radially expanded;

wherein substantially the sleeve is not uniformly expandable and comprises at least one hyper-expandable region that is adapted to expand more than other regions; wherein the sleeve comprises first and second axially spaced hyper-expandable regions, and a central region, located between the first and second axially spaced hyper-expandable regions, which is relatively more resistant to radial expansion than the first and second axially spaced hyper-expandable regions, whereby as a radial expansion force is applied to the sleeve, the first and second axially spaced hyper-expandable regions expand radially to a greater extent than the central region; and wherein the inwardly facing formation on the sleeve is disposed on the central region.

2. The tubular assembly according to claim 1, wherein the conduit is a wellbore tubular selected from the group consisting of casing and liner, and wherein the wellbore tubular is cemented in place within the wellbore.

3. The tubular assembly according to claim 1, wherein the hyper expandable regions are formed of a weaker material than at least one other region of the sleeve.

4. The tubular assembly according to claim 1 wherein at least a region of the inwardly facing formation is reinforced and is adapted to deform to a different extent in response to radial expansion forces than another region of the sleeve.

5. The tubular assembly according to claim 1 including a seal device disposed between the body and the sleeve.

6. The tubular assembly according to claim 5, wherein the seal device comprises a radially expandable seal on the body, adapted to pass through the bore of the sleeve in a first non-expanded configuration, and adapted to seal in the bore of the sleeve in a second radially expanded configuration.

7. The tubular assembly according to claim 1, wherein the downhole device incorporates a cutting device, adapted to cut tubing forming the conduit below the sleeve, and wherein inter-engaging said formations on the downhole device and the sleeve connect the sleeve to a cut upper portion of the tubing after the cutting device has cut the tubing, thereby allowing retrieval of the cut upper portion of the tubing by axially retrieving the cutting device which remains attached to the cut upper portion.

8. A method of deploying a downhole device in a wellbore, the downhole device having a body, the method comprising inserting a sleeve into a conduit in the wellbore, the sleeve having a bore adapted to receive the body of the downhole device, the bore having an inner circumferential surface comprising an inwardly facing formation on the sleeve adapted to engage with the body, and the sleeve being radially expandable, wherein the method includes the steps of: radially expanding the sleeve, by applying fluid pressure to the inner circumferential surface of the sleeve, to engage an outer circumferential surface of the sleeve to an inner surface of the conduit, and wherein said sleeve is not in a state of axial compression when said sleeve is radially expanded; inserting the body of the downhole device into a radially expanded bore of the sleeve, and engaging an outwardly facing formation on the body of the downhole device with the inwardly facing formation of the inner circumferential surface of the sleeve, wherein the downhole device incorporates a cutting device, and wherein the method includes the step of deploying the cutting device to cut tubing forming the conduit below the sleeve after the downhole device has been locked in position in the sleeve.

9. The method as claimed in claim 8, including the step of expanding at least a portion of the sleeve to a greater extent than at least one other portion of the sleeve.

10. The method as claimed in claim 8, including the step of expanding two axially spaced annular portions of the sleeve more than a portion of the sleeve between the two axially spaced expanded portions.

11. The method as claimed in claim 8, wherein at least one of the sleeve and the downhole device has a seal adapted to seal an annulus between the sleeve and the downhole device, and wherein the method includes the step of sealing the annulus between the sleeve and the downhole device.

12. The method as claimed in claim 8, including the step of locating sealing the bore of the sleeve in at least two axially spaced locations in the wellbore thereby isolating one zone of the wellbore from another.

13. The method as claimed in claim 8, including performing wellbore operations selected from the group consisting of producing fluids from one of the zones, and injecting fluids into one of the zones.

14. The method according to claim 8, including the step of passing the sleeve to through a relatively small diameter bore in a small diameter configuration, and subsequently expanding the sleeve in a larger diameter bore of the wellbore.

15. A tubular assembly for use in a wellbore of an oil, gas or water well, the tubular assembly comprising a cutting tool having a body, and a sleeve adapted to receive the body of the cutting tool, wherein the sleeve is adapted for retrospective deployment into a conduit in the wellbore so that the outer circumferential surface of the sleeve is radially expanded, by applying fluid pressure to an inner circumferential surface of the sleeve, against an inner surface of the conduit, the sleeve having a bore with the inner circumferential surface comprising an inwardly facing formation adapted to engage with an outwardly facing formation on the body of the cutting tool as the body of the cutting tool is disposed in the bore of the sleeve, wherein the cutting tool is adapted to cut tubing forming the conduit below the sleeve, and wherein inter-engaging said formations on the cutting tool and the sleeve connect the sleeve to a cut upper portion of the tubing after the cutting tool has cut the tubing, thereby allowing retrieval of the cut upper portion of the tubing by axially retrieving the cutting tool which remains attached to the cut upper portion.

16. A method of cutting an upper length of tubing which is to be replaced in a conduit of a wellbore, the method comprising: deploying a cutting tool in the wellbore, the cutting tool having a body; inserting a sleeve into the conduit of the wellbore, the sleeve having a bore adapted to receive the body of the cutting tool, the bore having an inner circumferential surface comprising an inwardly facing formation on the sleeve adapted to engage with the body; radially expanding the sleeve, by applying fluid pressure to the inner circumferential surface of the sleeve, to engage an outer circumferential surface of the sleeve to an inner surface of the conduit; inserting the body of the cutting tool into a radially expanded bore of the sleeve; engaging an outwardly facing formation on the body of the cutting tool with the inwardly facing formation of the inner circumferential surface of the sleeve to lock the cutting tool in position in the sleeve; using the cutting tool to cut tubing forming the conduit below the sleeve; and retrieving a cut upper portion of the tubing by axially retrieving the cutting tool which remains attached to the cut upper portion.

* * * * *